United States Patent [19]

Lavery

[11] 4,354,596

[45] Oct. 19, 1982

[54] CARTON WITH INVERTED INTERNAL PLATFORM AND CARTON BLANK THEREFOR

[75] Inventor: John J. Lavery, Chicago, Ill.

[73] Assignee: Champion International Corporation, Stamford, Conn.

[21] Appl. No.: 236,936

[22] Filed: Feb. 23, 1981

[51] Int. Cl.[3] ..... B65D 25/54; B65D 65/16

[52] U.S. Cl. ..... 206/45.31; 206/45.34; 206/45.19; 229/39 R

[58] Field of Search ..... 206/45.31, 45.34, 45.19, 206/45.14, 216; 229/27, 39 R, 38

[56] References Cited

U.S. PATENT DOCUMENTS

| | | | |
|---|---|---|---|
| 2,019,250 | 10/1935 | Collins | 206/45.19 |
| 2,866,588 | 12/1958 | Bolding | 229/27 |
| 3,089,631 | 5/1963 | Tyrseck et al. | 206/45.19 |
| 3,133,634 | 5/1964 | Bulovic | 206/216 |
| 3,302,852 | 2/1967 | Johnson et al. | 229/39 R |

*Primary Examiner*—William T. Dixson, Jr.

*Attorney, Agent, or Firm*—Evelyn M. Sommer; William W. Jones

[57] ABSTRACT

A paperboard windowed carton to display the entire front area of its contents is formed from a one-piece carton blank. The carton comprises a front panel, a back panel, and two opposite side panels, with the front panel having a window preferably covered with a transparent film such as cellophane. Top panels form a top enclosure for the carton and bottom panels form an inverted platform within the carton. The bottom panels are a first and second inverting panel connected respectively to the front and back panels and adhered to their inside faces, and a first and a second platform panel each connected to a respective inverting panel.

2 Claims, 3 Drawing Figures

CARTON WITH INVERTED INTERNAL PLATFORM AND CARTON BLANK THEREFOR

BACKGROUND OF THE INVENTION

The present invention relates to one-piece carton blanks and the cartons erected thereform, and more particularly to such cartons having windows in their front panels for displaying merchandise within the cartons.

It is often desirable that the items within a carton be displayed to potential customers. An alternative to such display is to print a drawing or picture of the item on the carton or on an adjacent display piece. However, the picture may not fully or fairly portray the item, particularly if the item is complex in shape or intended for children. For example, a picture of a Christmas toy may not be nearly as realistic or life-like, particularly to a child, as seeing the toy itself. If the child can see the toy, he may be prompted to seek its purcahse.

Some cartons now available have sought to display their contents by means of a window on the front panel. However, generally the window area is only a part of the area of the panel and consequently only a portion of the item is seen. The bottom portion of the front panel, which frequently is of paperboard instead of a transparent material, often obscures the bottom portion of the item within the carton.

OBJECTIVES AND FEATURES OF THE INVENTION

It is an objective of the present invention to provide a carton manufactured from a one-piece paperboard carton blank which provides a window area through which the entire item within the carton may be viewed.

It is a further objective of the present invention to provide such a carton which, after it has been erected and the item inserted, may be readily closed by a simple hand or machine motion.

It is a further objective of the present invention to provide such a carton in which the window is covered by a transparent film material which protects the item within the carton and yet enables the potential customer to see the entire front face of the item.

It is a further objective of the present invention to provide such a carton which may be manufactured using conventional carton-making machinery and technology from a one-piece paperboard blank so as to be reasonable in cost.

It is a feature of the present invention to provide a carton blank to form the carton. The erected carton comprises a plurality of central panels joined along articulated fold lines, the central panels being a front panel, its opposite back panel, and two opposite side panels. The front panel has a window to show the entire front of the carton's contents, preferably covered by a transparent film and being the entire width of the front panel.

A plurality of bottom panels form an inverted platform within the carton. The bottom panels include a first inverting panel articulatedly connected to the front panel and adhered to its inside face, a first platform panel articulatedly connected to the first inverting panel and perpendicular thereto, a second inverting panel articulatedly connected to the back panel and adhered to its inside face, and a second platform panel lying on the first platform panel and articulatedly connected to the second inverting panel.

BRIEF DESCRIPTION OF THE DRAWINGS

Other objectives and features of the present invention will be apparent from the following detailed description of the invention taken in conjunction with the accompanying drawings. In the drawings.

DETAILED DESCRIPTION OF THE INVENTION

Figure 1:
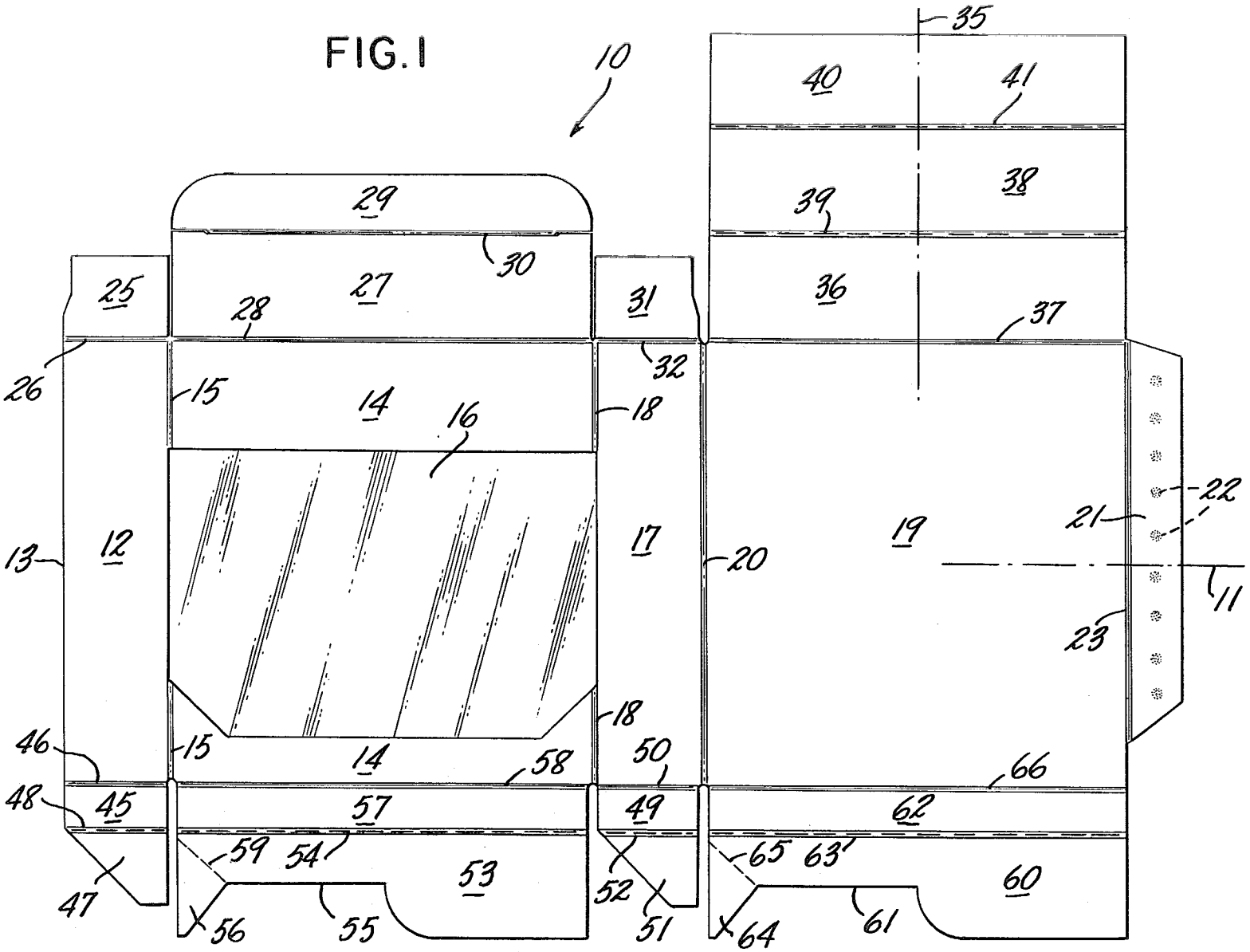
FIG. 1 is a top plan view of the one-piece paperboard carton blank of the present invention.
Figure 2:
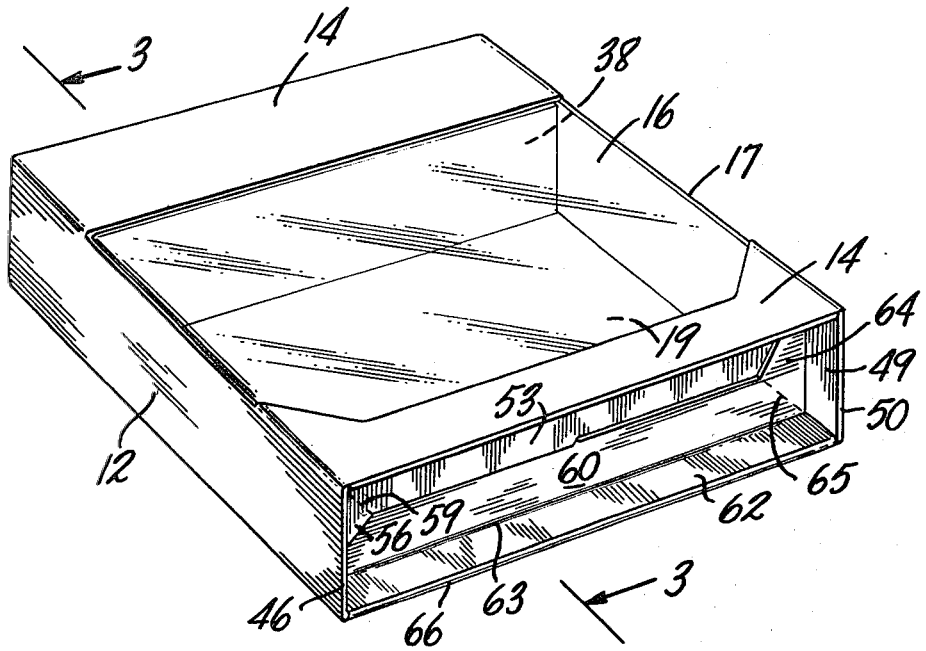
FIG. 2 is a perspective view of the carton which has been erected from the paperboard blank of FIG. 1 and shows the bottom of its inverted platform.
Figure 3:
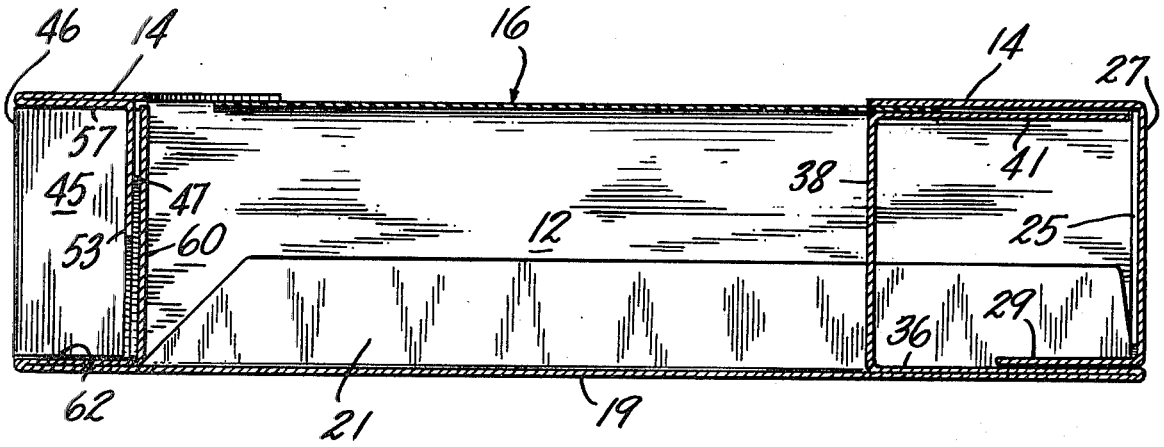
FIG. 3 is a cross-sectional view taken along line 3—3 of FIG. 3.

The one-piece paperboard carton blank 10 of the present invention is shown in FIG. 1. The carton blank 10 may be made of coated cardboard or other suitable paperboard products. The blank 10 is shown in FIG. 1 with its exterior face upright and with its interior face, i.e., the face which is in contact with its contents, on the back side of the blank.

The one-piece paperboard blank 10 includes a series of central panels connected by fold lines along an imaginary central axis 11. These central panels include a first side panel 12 having a free edge 13. The first side panel 12 is connected to the front panel 14 by the fold line 15. The front panel 14 has a window 16 which permits viewing of the contents after the carton has been erected and filled. Preferably the window 16 is covered by a transparent film, such as cellophane, which is adhered to the back side of the blank 10. Preferably the window 16 provides a full view of the carton's contents and for this purpose extends the full width of the front panel 14.

The front panel 14 is connected to the second side panel 17 by the fold line 18. The second side panel 17 is connected to the back panel 19 by the fold line 20. A side glue panel 21, having an adhesive area 22 on its front face, is connected to the back panel 19 by a fold line 23.

A series of flap members are provided along the top of the carton blank to close the top end of the erected carton. These flaps include a first side flap 25 connected to the side panel 12 by the fold line 26. A top flap 27 is connected to the front panel 14 by the fold line 28 and is connected to the top flap lip panel 29 by the fold line 30. The second side flap 31 is connected to the second side panel 17 by the fold line 32.

A series of panels are aligned, in sequence, along an imaginary axis 35 perpendicular to the imaginary axis 11. These support panels, in the erected carton, are used to support the top of the goods being displayed and form a shelf for that purpose within the carton. These support panels include support panel 36, which is connected to the back panel 19 by the fold line 37, and support panel 38, which is connected to the support panel 36 by the fold line 39. The support panels further include the support panel 40 which is connected to the support panel 38 by the fold line 41. The support panel 36 has an adhesive area (not shown) on its back face which is utilized, when the carton is glued and erected, to adhere the back face of the support panel 36 to the back face of the upper area of the back panel 19.

A series of platform panels are arranged along the bottom of the carton blank to automatically lock the bottom of the glued and erected carton and to form an inverted platform within the carton. These bottom panels include the side flap 45 which is connected to the first side panel 12 by the fold line 46 and has an adhesive area on its back face (not shown). It is connected to triangular flap 47 by the fold line 48. Similarly, the side flap 49, having an adhesive area on its back face (not shown), is connected to the second side panel 17 by the fold line 50 and it is connected to the triangular flap 51 by the fold line 52. A first platform panel 53 is connected to its inverting panel 57 by the fold line 54. The inverting panel 57 has an adhesive area on its back face (not shown) and is connected to the front panel 14 by the fold line 58. The first platform panel 53 has an indented portion 55, which permits fingers to be inserted, and a triangular panel 56 connected thereto by the fold line 59. Similarly, the second platform panel 60 has an indented portion 61, is connected to its inverting panel 62 by the fold line 63, and is connected to triangular panel 64 by the fold line 65. The inverting panel 62 has an adhesive area on its back face (not shown) and is connected to the back panel 19 by the fold line 66.

The carton is erected and glued in the following steps. The rear face of support panel 36 is adhered to the top portion of the rear face of back panel 19 and the adhesive area on the front face of the side glue panel 21 is adhered to the rear face of the side panel 12. The adhesive areas on the rear faces of the side flaps 45,49 are adhered to the inside (rear) faces of their respective side panels 12,17. The adhesive areas on the rear faces of the inverting panels 57,62 are adhered to the inside (rear) faces, respectively front panel 14 and back panel 19. The support panel 38 is folded perpendicularly to the support panel 36 and the support panel 40 is folded perpendicularly thereto so that it lies flat against the inside face of the top portion of the front panel 14. The side flaps 25,31 are folded inwardly and they are covered by the top flap 27 whose top flap lip panel 29 is inserted to lie flat against the back panel 19. The top of the carton has been closed and a platform formed therein, flush with the top of the window, by support panel 38. The first platform panel 53 and second platform panel 60 are pushed inwardly to form the platform under the contents. Preferably the free edge of the platform panel 53 fits into the fold line between panels 62,60 to hold platform panel 53 in position.

The item is inserted so that it rests on the support panel 38.

What is claimed is:

1. A display carton formed from a one-piece paperboard blank, said carton comprising:

(a) parallel spaced apart front and back panels having respective side edges interconnected by parallel spaced apart side panels, said side panels being foldably connected to said front and back panels;

(b) means forming a window in said front panel whereby contents of said carton can be viewed, said window having top, bottom and side edges;

(c) means forming a bottom closure for said carton, said bottom closure comprising a first inverting panel foldably connected to a bottom edge of said front panel and adhesively secured to the inside surface of said front panel; a first support panel foldably connected to said first inverting panel and extending perpendicularly therefrom toward said back panel; a second inverting panel foldably connected to a bottom edge of said back panel and adhesively secured to the inside surface of said back panel; a second support panel foldably connected to said second inverting panel and extending perpendicularly therefrom toward said front panel, said first and second support panels having freely pivotable overlapping adhesive-free portions operative to support an article disposed in the carton, and said first and second support panels being disposed closely adjacent to said bottom edge of said window; and (d) means forming a top closure for said carton, said top closure comprising a first support panel foldably connected to a top edge of one of said front and back panels and adhesively secured to the inside surface of said one of said front and back panels; a second support panel foldably connected to said first support panel and extending perpendicularly therefrom toward the other of said front and back panels; and a third support panel foldably connected to said second support panel and extending perpendicularly therefrom toward the upper edge of the other of said front and back panels, said third support panel lying flat against the inside of said other of said front and back panels but free of securement thereto, whereby said second and third support panels can be pulled through the upper end of said carton to permit placing of contents in said carton; said top closure further comprising a top flap foldably connected to a top edge of the other of said front and back panels and extending perpendicular thereto toward said one of said front and back panels, said top flap having a lip panel foldably connected thereto and extending perpendicular to said top flap in face-to-face contact with an exposed surface of said first support panel.

2. The display carton of claim 1 wherein said second support panel is aligned with said top edge of said window.

* * * * *